US005292110A

United States Patent [19]

Honegger

[11] Patent Number: 5,292,110

[45] Date of Patent: Mar. 8, 1994

[54] SIGNATURE TRANSPORT WITH SELECTIVE PARALLEL OR SERIES PATHS

[75] Inventor: Werner Honegger, Tann Rüti, Switzerland

[73] Assignee: Ferag AG, Hinwil, Switzerland

[21] Appl. No.: 871,825

[22] Filed: Apr. 21, 1992

[30] Foreign Application Priority Data

Apr. 26, 1991 [CH] Switzerland ..... 01267/91-4

[51] Int. Cl.[5] ..... B65H 5/30; B65H 39/02

[52] U.S. Cl. ..... 270/55; 270/58

[58] Field of Search ..... 270/12, 15, 17, 53, 270/54, 55, 57, 58

[56] References Cited

U.S. PATENT DOCUMENTS

| | | | |
|---|---|---|---|
| 3,271,023 | 9/1966 | Disbrow et al. | 270/58 |
| 3,951,399 | 4/1976 | Reist | 270/58 |
| 4,034,974 | 7/1977 | Maopolski | 271/184 |
| 4,477,067 | 10/1984 | Wise | 270/57 |
| 4,489,930 | 12/1984 | Meier | 270/55 |
| 4,684,117 | 8/1987 | Honegger et al. | 270/54 |
| 4,743,005 | 5/1988 | Reist | 270/1 |
| 4,811,938 | 3/1989 | Hänsch | 270/54 |
| 5,007,629 | 4/1991 | Eberle et al. . | |
| 5,019,716 | 5/1991 | Meier et al. | 270/55 |
| 5,052,666 | 10/1991 | Hänsch | 270/55 |
| 5,094,438 | 3/1992 | Reist et al. | 270/55 |
| 5,104,108 | 4/1992 | Honegger | 270/55 |
| 5,116,033 | 5/1992 | Honegger | 270/55 |

FOREIGN PATENT DOCUMENTS

| | | |
|---|---|---|
| 0095603 | 5/1983 | European Pat. Off. . |
| 0346578 | 4/1989 | European Pat. Off. . |
| 0354343 | 7/1989 | European Pat. Off. . |
| 3705257 | 2/1987 | Fed. Rep. of Germany . |

*Primary Examiner*—Edward K. Look
*Assistant Examiner*—John Ryznic
*Attorney, Agent, or Firm*—Willian Brinks Olds Hofer Gilson & Lione

[57] ABSTRACT

A conveying apparatus comprises supports arranged in tandem and revolvingly driven in a predetermined direction of revolving motion. Along the upper run of the conveying apparatus there are provided a first processing path and a second processing path which are mutually parallel and arranged side-by-side in laterally offset relationship. These processing paths are connectable in parallel or in series by means of a reversible belt conveyor. Each processing path is provided with a number of infeed stations for infeeding printed products. During series operation there is deposited at each infeed station of the first processing path a printed product in a straddling fashion upon each support moving therepast or upon the printed product or products previously deposited thereupon. In the region of the lower run of the conveying apparatus, the intermediate products formed in the first processing path are displaced transversely relative to the direction of revolving motion and supplied to the second processing path, whereby the infeed stations of the latter deposit in a straddling fashion further printed products upon the intermediate products. Subsequently, all collected printed products are stapled by means of a stapling apparatus and the end products are transported away. In the case of parallel operation, the first processing path and the second processing path operate isochronously parallel to one another and the collected end products are transported away at the end of each processing path.

27 Claims, 5 Drawing Sheets

SIGNATURE TRANSPORT WITH SELECTIVE PARALLEL OR SERIES PATHS

CROSS-REFERENCE TO RELATED PATENT APPLICATIONS

This application is related to the commonly assigned, copending U.S. Pat. No. 5,104,108, filed Jun. 13, 1989, entitled "APPARATUS FOR COLLECTING, ASSEMBLING AND INSERTING PRINTERY PRODUCTS", and the commonly assigned copending U.S. Pat. No. 5,094,348, filed Jul. 31, 1989, entitled "PROCESS FOR THE PRODUCTION OF MULTIPART PRINTED PRODUCTS, PRINTED PRODUCT PRODUCED BY THE PROCESS, AND DEVICE FOR CARRYING OUT THE PROCESS".

BACKGROUND OF THE INVENTION

The present invention broadly relates to collecting, assembling and inserting printed products and producing multipart printed products and pertains, more specifically, to a new and improved method of processing printed products, such as newspapers, magazines and the like. The present invention also relates to a new and improved apparatus for carrying out the inventive method.

Generally speaking, the method of the present invention is of the type according to which printed products are collected or assembled along a first processing path to produce an end product or an intermediate product and subsequently transported away.

A prior art apparatus for collecting folded printed sheets according to a method of the previously mentioned type is known, for example, from European Patent Application No. 0,095,603, published Dec. 7, 1983 and the corresponding U.S. Pat. No. 4,489,930, granted Dec. 25, 1984 and assigned to the assignee of the instant application. This apparatus disclosed to the art comprises a collecting conveyor with a traction element having two parallel and endless revolving chains trained about two axes arranged at a spacing from each other in a horizontal plane. At these endless chains there are secured receiving saddles arranged behind one another in the manner of wrungs of a ladder. Along the upper run extending substantially in the horizontal direction, there are provided a number of infeed devices arranged in succession or tandem and serving to deposit folded printed sheets in a straddling fashion upon the receiving saddles or, as the case may be, the folded sheet or sheets already positioned on the latter. As viewed in the direction of revolving motion of the collecting conveyor, an outfeed or delivery device is arranged downstream of the infeed devices for the purpose of transporting away the collected folded printed sheets positioned one on top of the other. The processing path in this known collecting conveyor thus extends along the upper run of the driven revolving traction element. Each infeed device comprises an endless revolving drive element provided with individually controllable grippers attached thereto in tandem relationship and at a uniform spacing from one another, whereby each gripper fixedly retains a folded printed sheet. The respective transfer or delivery regions of the infeed devices extend in the same direction as the conveying direction of the upper run of the collecting conveyor. Each transfer or delivery region is operatively associated with an opening device, by means of which the folded printed sheets retained at their respective folds by the related grippers are opened prior to transfer to the collecting conveyor. The largest number of folded printed sheets that can be deposited upon the receiving saddles is given by the number of infeed devices arranged along the upper run. In other words, as many infeed devices can be operatively associated with the collecting conveyor as would correspond to the number of folded printed sheets to be collected.

An apparatus for and a method of collecting printed products as well as assembling and inserting printed products have been disclosed to the art, for instance, in European Patent Application No. 0,346,578, published Dec. 20, 1989 and the aforementioned copending U.S. Pat. No. 5,104,108, and in European Patent Application No. 0,354,343, published Feb. 14, 1990 and the aforementioned copending U.S. Pat. No. 5,094,348. The apparatus comprises an endless revolvingly driven traction or driving element, at which there are provided saddle-shaped supports extending at right angles relative to the direction of revolving motion, whereby two adjacent supports bound or delimit in each case a pocket-shaped receiving section. The revolvingly driven traction element is trained around two stationarily mounted deflection wheels with respective axes arranged at a distance from each other in a horizontal plane. In the region of the upper run which extends substantially in the horizontal direction, there are successively or tandemly arranged a number of infeed devices for the purpose of inserting or stuffing printed products supplied by the latter into the pocket-shaped receiving sections or for the purpose of depositing folded printed products in a straddling fashion upon the saddle-shaped supports. The infeed devices comprise respective revolvingly driven traction elements. At each of these traction elements there are arranged in tandem relationship individually controllable grippers, the conveying direction of which extends in each transfer or delivery region approximately in the same direction as the direction of revolving motion of the endless and revolvingly driven traction element of the apparatus. Each infeed device is operatively associated with an opening device, in order to open the folded printed products retained by the grippers in the region of their respective folds prior to being transferred and deposited upon their respective saddle-shaped supports. However, the opening devices remain inactive when the printed products supplied by the respective infeed devices are to be inserted or stuffed into respective receiving sections. As viewed in the direction of revolving motion of the conveying apparatus, an outfeed or delivery device is arranged downstream of the infeed devices, i.e. in the end region of the upper run of the conveying apparatus. Such outfeed device is provided with a revolving traction element comprising individually controllable grippers arranged behind one another, in order to transport away the printed products stuffed into the receiving sections and/or the printed products deposited or positioned on the saddle-shaped supports. These prior art collecting conveyors also comprise a linear processing path which extends along the upper run of the conveyor and within which printed products are collected, assembled or inserted into one another. The processing capacity is limited by the highest possible processing speed, and the number of different printed products is given by the number of infeed devices provided along the upper run.

A further apparatus for stuffing inserts into folded or bound multisheet printed products is known, for example, from German Patent Application No. 3,705,257, published Oct. 8, 1987 and the cognate U.S. Pat. No. 4,473,005, granted May 10, 1988 and assigned to the assignee of the instant application. The installation or apparatus disclosed therein comprises a traction element composed of two endless, mutually parallel and revolvingly driven drive elements in the form of chains, each of the latter being guided over a driven sprocket wheel and trained around a deflection wheel, the axes thereof being situated in a horizontal plane. Pockets closely arranged in tandem relationship and extending at right angles relative to the direction of revolving motion are secured to the aforesaid traction element. A carriage or sled located in each pocket is displaceably guided in the lengthwise direction of the pocket. In the region of the horizontally extending upper run and as viewed in the direction of revolving motion, several infeed devices are provided and an outfeeder or delivery device is arranged downstream of the infeed devices, i.e. at the end region of the upper run. At the start of the upper run, each carriage or sled is disposed in a first end position when the related pocket is located in the transfer or delivery region of the first infeed device. In other words, the carriage is located on the right side of the pocket as viewed in the direction of revolving motion and the first infeed device inserts a folded printed product into the pocket such that the folded printed product comes to rest with its leading downsided fold upon the carriage. In the region following the first infeed device, the carriage of the respective pocket is shifted towards the left, as viewed in the direction of revolving motion, into a second end position, whereby the folded printed product is positively opened in the course of displacement. Each of the following infeed devices now supplies a further printed product, i.e. an insert or supplement, into the opened first folded printed product. As soon as all inserts have been stuffed into the first folded printed product located in the respective pocket, the carriage or sled together with the completed end product is shifted back to the right and thus into the first end position, whereby the previously infed inserts are aligned with respect to the folded printed product during the second displacement. In this first end position the completed end product can be engaged by the outfeed device, lifted out of the respective pocket and transported away. The infeed devices provided between the first infeed device and the outfeed device are arranged in a lateral offset relationship with respect to the first infeed device and the outfeed device. This known apparatus for stuffing inserts or supplements into folded or bound multisheet printed products requires a great deal of space due to the necessary width and comprises a curvilinear processing path in the region of the upper run.

SUMMARY OF THE INVENTION

Therefore, with the foregoing in mind, it is a primary object of the present invention to provide a new and improved method of, and apparatus for, processing printed products and which are not afflicted with the drawbacks and limitations of the prior art.

Another and more specific object of the present invention aims at providing a new and improved method of and apparatus for processing printed products and by means of which there is selectively ensured an augmented processing capacity or the processing of a larger number of different printed products to be assembled or brought together.

Yet a further significant object of the present invention aims at providing a new and improved method of, and apparatus for, optimizing the processing of printed products and which permit using the simplest possible means requiring a minimum of space, and which apparatus is relatively economical to manufacture and yet affords highly reliable operation thereof.

Now in order to implement these and still further objects of the present invention, which will become more readily apparent as the description proceeds, the method of the present development is manifested, among other things, by the steps of providing a second processing path, selectively connecting this second processing path in parallel or in series to the first processing path, simultaneously collecting or assembling further printed products along this second processing path, and subsequently transporting away the collected or assembled further printed products.

The method aspects of the present development further contemplate providing an endless revolving conveying apparatus passing through both processing paths which at least by sectors are substantially linear, providing infeed stations successively arranged along the processing paths, and transferring the printed products at the infeed stations to the endless revolving conveying apparatus.

In accordance with the inventive method, the printed products are processed in two, i.e. at least two, processing paths selectively connectable in series or in parallel. Compared with prior art apparatus for collecting, assembling or inserting printed products and equipped with a single processing path or stretch, the apparatus carrying out the method of processing printed products according to the present invention is far more efficient. Provided the processing speed is the same, the capacity or output is doubled when the two processing paths operate in parallel. In series operation of the two processing paths, up to twice as many printed products can be collected and/or assembled.

As alluded to above, the invention is not only concerned with the aforementioned method aspects, but also relates to a new and improved apparatus or installation for carrying out and performing the inventive method of processing printed products.

Generally speaking, the new and improved apparatus or installation for processing printed products, such as newspapers, magazines and the like, is of the type comprising an endless revolving conveying apparatus passing through a first processing path which, at least by sectors, is substantially linear. The conveying apparatus is provided with saddle-shaped supports for the purpose of taking-up or receiving folded printed products in a straddling fashion or configuration, these saddle-shaped supports extending transversely with respect to the predetermined direction of revolving motion of the conveying apparatus. Along the aforesaid first processing path there are provided several infeed stations for the purpose of depositing the folded printed products in a straddling fashion or configuration upon the saddle-shaped supports or, as the case may be, upon a folded printed product or a number of folded printed products previously deposited thereupon, these infeed stations being successively or tandemly arranged. Furthermore, as viewed in the predetermined direction of revolving motion, there is provided an outfeed station arranged downstream of the infeed stations for the purpose of outfeeding or delivering the folded printed products deposited one on top of the other.

Alternatively, the new and improved apparatus for processing printed products is of the type comprising an endless revolving conveying apparatus passing through a first processing path which, at least by sectors, is substantially linear. This endless revolving conveying apparatus is provided with pocket-like receiving sections for the purpose of receiving printed products, these pocket-like receiving sections extending transversely with respect to the predetermined direction of revolving motion of the conveying apparatus. Along the first processing path there are provided several infeed stations serving to insert or stuff the printed products into the pocket-like receiving sections, these infeed stations being arranged in succession or in tandem. Furthermore, an outfeed station is arranged downstream of the infeed stations, as viewed in the predetermined direction of revolving motion, for the purpose of outfeeding or delivering the printed products inserted or stuffed into the pocket-like receiving sections.

In order to implement the aforementioned objects and still further objects of the present invention, which will become more readily apparent as the description proceeds, the apparatus of the present invention is manifested, among other things, by the features that there is provided a second processing path along which there are successively arranged several infeed stations. A further outfeed station is arranged downstream of these infeed stations as viewed in the predetermined direction of revolving motion. The endless revolving conveying apparatus passes through this second processing path. Means are provided for the purpose of selectively connecting the two processing paths in parallel or in series, whereby the outfeed station associated with the first processing path is disengageable when the two processing paths are connected to operate in series.

It is a matter-of-course that the apparatus is not limited to two processing paths. The apparatus can be also readily realized with three and even more processing paths which can be selectively connected in parallel or in series.

The means for selectively connecting the two processing paths either in parallel or in series, as well as appropriate conveying-active transport means are preferably provided between the end portion of the first processing path and the start portion of the second processing path, as viewed in the predetermined direction of revolving motion. These transport means are conveying-active when the two processing paths are connected to operate in series.

In a preferred exemplary embodiment of the apparatus constructed according to the present invention there are provided pocket-like receiving sections between the saddle-shaped supports, whereby the infeed stations successively or tandemly arranged along the two processing paths are structured to selectively deposit folded printed products upon the saddle-shaped supports and insert printed products into the pocket-like receiving stations. The printed products can be thus collected as well as assembled. Furthermore, it is possible to deposit a folded printed product in a straddling fashion over assembled printed products.

In an exemplary embodiment allowing high processing speeds the infeed stations comprise respective infeed devices, each of which is provided with revolvingly driven and tandemly arranged grippers and contains a delivery region for product transfer to the endless revolving conveying apparatus. The conveying direction of the driven grippers in the aforesaid delivery region extends approximately in the same direction with respect to the predetermined direction of revolving motion of the conveying apparatus. Opening devices are provided for opening the folded printed products to be deposited upon the saddle-shaped supports. With this preferred exemplary embodiment considerable time is gained for the transfer of printed products from the infeed devices to the saddle-shaped supports or, as the case may be, the pocket-like receiving sections. Accordingly, higher processing speeds are rendered possible.

According to a preferred construction requiring a minimum of space, the two processing paths extend side by side and substantially parallel to each other, and the saddle-shaped supports together with the pocket-like receiving sections of the conveying apparatus are commonly associated to the mutually parallel processing paths.

According to a particularly simple and preferred embodiment the endless revolving conveying apparatus comprises an upper run, which extends along the two processing paths, and a lower run. Retaining means provided in the region of the lower run serve to prevent the printed products from falling down. Furthermore, the aforesaid means for selectively connecting the processing paths in parallel or in series comprise a transport device preferably likewise located in the region of the lower run and serving to convey, during series connection of the processing paths, the printed products in a direction transverse relative to the predetermined direction of revolving motion.

The aforesaid retaining means comprise endless retaining belts or bands or chains revolving externally of the conveying apparatus, whereby each endless retaining belt or band or chain contains a retaining-active run. These belts or bands or chains are arranged with their respective retaining-active runs at a slight spacing from the saddle-shaped supports or bear with their respective retaining-active runs at the saddle-shaped supports or, as the case may be, at the printed product or products deposited thereat.

The aforedescribed endless revolving conveying apparatus is extremely simple in construction and design, considering the fact that the individual saddle-shaped supports and pocket-like receiving sections contain neither retaining means for preventing the printed products from falling down nor conveying means to shift the printed products in the lengthwise direction of the supports and of the receiving sections, respectively.

The aforementioned transport device located in the region of the lower run of the endless revolving conveying apparatus comprises an endless belt or chain conveyor which is revolvingly driven in a direction extending transversely to the predetermined direction of revolving motion and contains a conveying-active run facing the conveying apparatus. The printed products come to bear upon this conveying-active run and are at the same time prevented from falling off the supports or falling out of the receiving sections.

According to a particularly simple and practical construction the outfeed station associated with the first processing path is provided in the region of the lower run of the endless revolving conveying apparatus and the aforesaid retaining means further comprise a belt conveyor which is pivotable in switch-like manner between a retaining position and an outfeed position. In the retaining position of this pivotable belt conveyor the printed products are prevented from falling off the saddle-shaped supports or, as the case may be, from falling out of the pocket-like receiving sections. In the outfeed position, this belt conveyor delivers the respective printed products to the outfeed station associated with the first processing path.

The pocket-like receiving sections are bounded or delimited by wall elements associated in each case with the neighboring saddle-shaped supports, whereby preferably in each case one of these bounding wall elements is pivotably mounted and, by means of a control device, is pivotable with its free end to move under a related support element. In this way the printed products inserted into the receiving sections and bearing at the pivotably mounted wall element can be brought under the related support element.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters and numerals to denote the same or analogous components and wherein.

DETAILED DESCRIPTION OF THE PREFERRED EMBODIMENTS

Describing now the drawings, it is to be understood that to simplify the showing thereof, only enough of the construction of the apparatus for processing printed products has been illustrated therein as is needed to enable one skilled in the art to readily understand the underlying principles and concepts of this invention.

Figure 1:
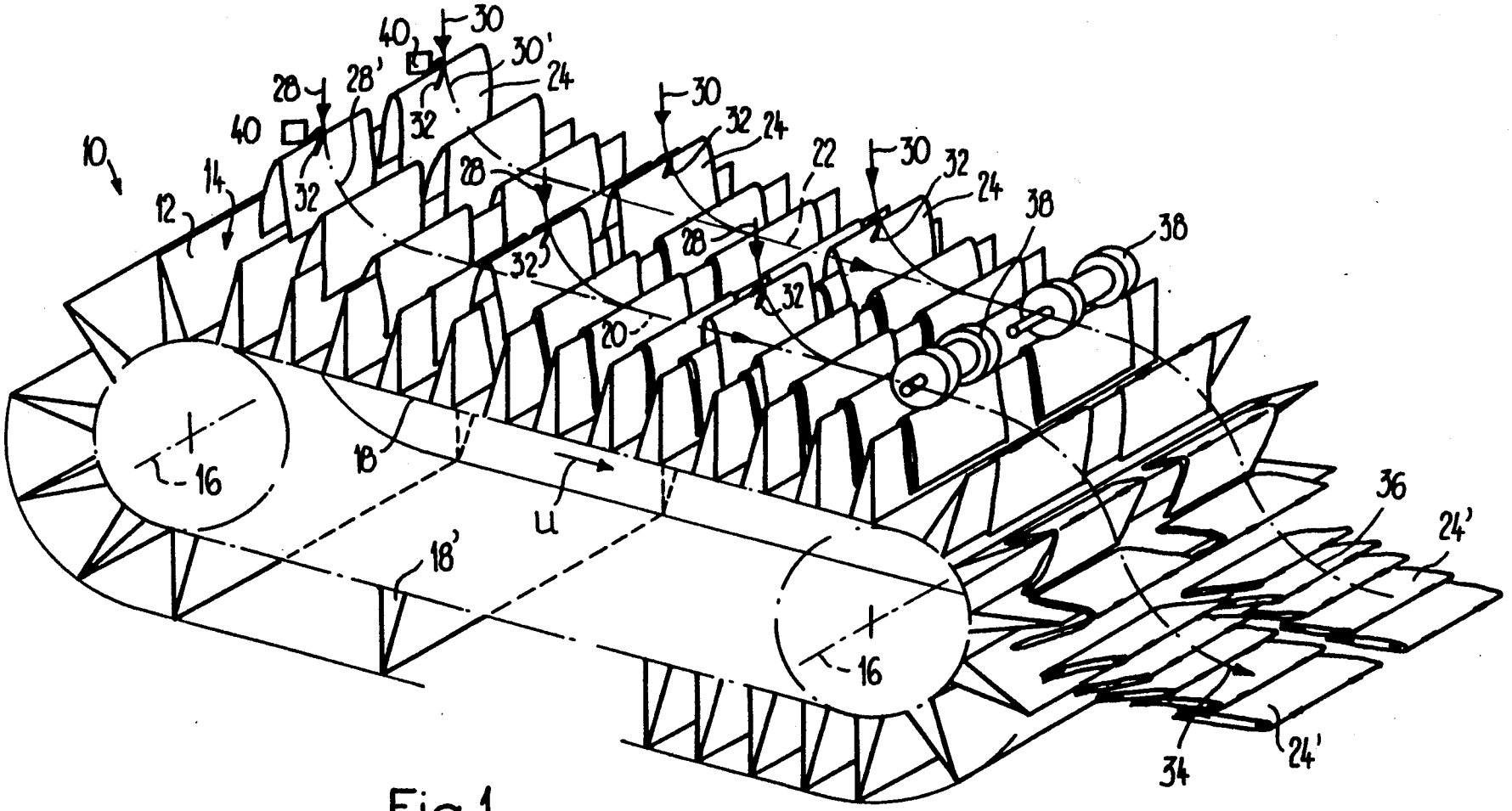
FIG. 1 schematically shows in a perspective view and in a simplified illustration a part of the apparatus constructed according to the present invention and shown with processing paths connected in parallel.
Figure 2:
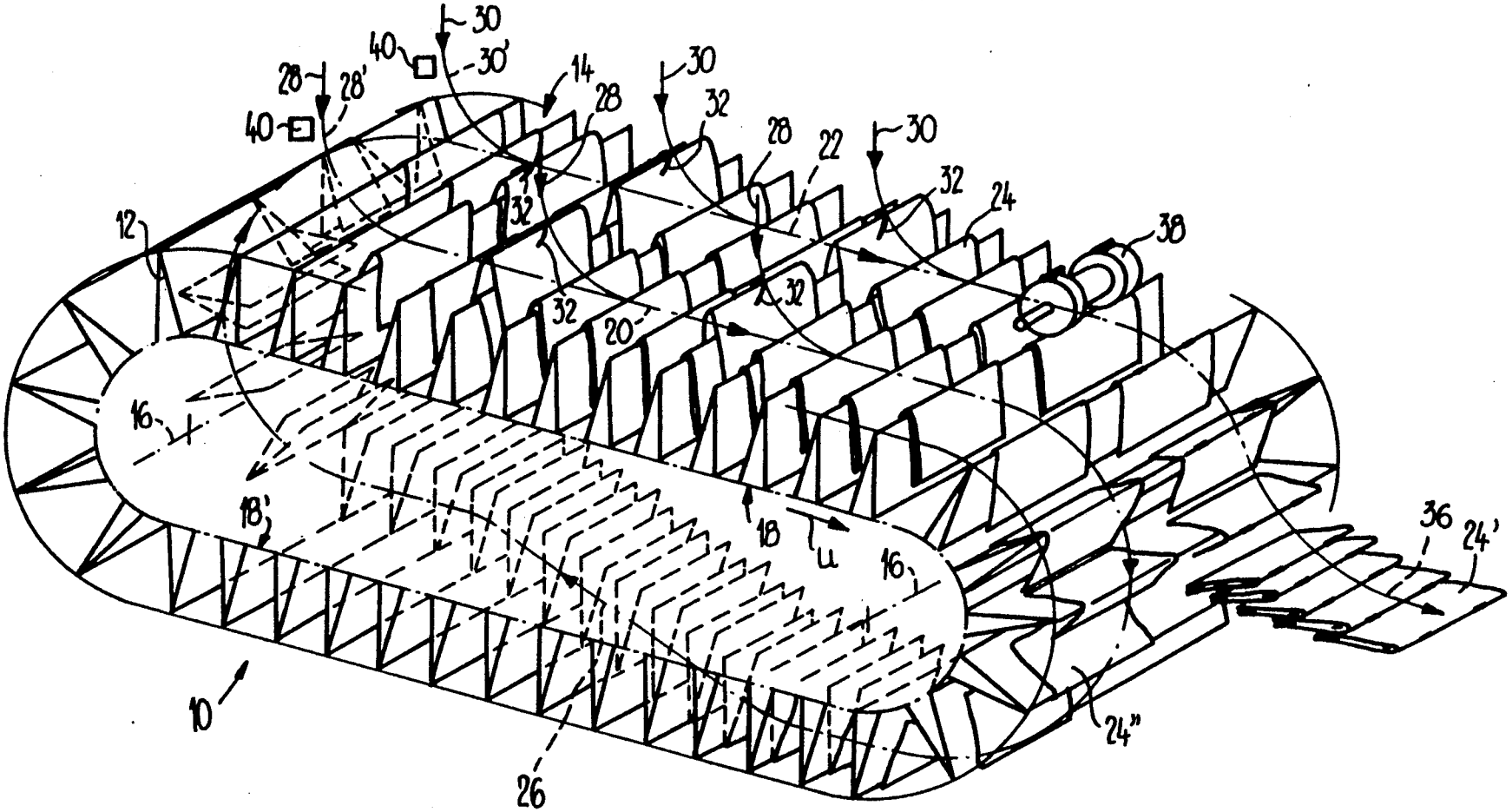
FIG. 2 schematically shows the part of the apparatus constructed according to the invention in a perspective view corresponding to that in FIG. 1, with the difference that here the processing paths are connected in series.

Turning attention now specifically to FIGS. 1 and 2 of the drawings the apparatus constructed according to the present invention and illustrated therein by way of example and not limitation will be seen to comprise a conveying apparatus 10 having a predetermined direction of revolving motion or circulation U. This conveying apparatus 10 comprises saddle-shaped supports 12 revolvingly driven in the direction of revolving motion U and arranged in tandem, the lengthwise extension of these saddle-shaped supports 12 extending at right angles relative to the direction of revolving motion U. Two successive or adjacent saddle-shaped supports 12 delimit or bound therebetween in each case a pocket-like receiving section 14. The saddle-shaped supports 12 are trained about two horizontal axes 16 which are arranged at a distance from each other, so that the conveying apparatus 10 comprises a linear upper run 18 extending approximately in the horizontal direction and a lower run 18'.

In the region of the linear upper run 18 of the conveying apparatus 10 there is provided a linear first processing path 20 depicted by an arrow, and parallel thereto and laterally offset therefrom, as viewed in the direction of revolving motion U, there is provided a second processing path 22 likewise depicted by an arrow. Under the term "processing path" there is to be understood that part or portion of the entire apparatus, in which printed products 24 are not only transported or conveyed, but also deposited, collected, assembled, inserted, stapled or stitched, adhesively bonded, cut and so forth. The endless revolving conveying apparatus 10 thus passes through both linear processing paths 20 and 22.

The processing paths 20 and 22 can be operated in parallel as depicted in FIG. 1, or in series as depicted in FIG. 2. For this purpose, there are provided means 26 which are indicated only by an arrow in FIG. 2 and arranged in the region of the lower run 18' of the conveying apparatus 10. These means 26, which will be described hereinafter in greater detail, serve to ensure, on the one hand, that the printed products 24 coming from the first processing path 20 are supplied to the second processing path 22 when the processing paths 20 and 22 are connected in series and, on the other hand, that these printed products 24 coming from the first processing path 20 are transported away when the two processing paths 20 and 22 are connected to work in parallel.

Several infeed stations 28 serving to supply the printed products 24 and also only indicated by respective arrows are operatively associated with the first processing path 20. Several infeed stations 30 for supplying the printed products 24 and likewise only indicated by respective arrows are operatively associated with the second processing path 22. These infeed stations 28 and 30 are of generally known design and construction, but preferably comprise respective infeed devices 28' and 30' only schematically indicated at the first upstream infeed stations 28 and 30, as viewed in the direction of revolving motion U. Each of these infeed devices 28' and 30' comprises revolvingly driven and successively arranged individually controllable grippers 32, these grippers 32 having in the transfer region for delivery of the printed products 24 to the conveying apparatus 10 a conveying direction extending approximately in the same direction as the direction of revolving motion U. Downstream of the successively or tandemly arranged infeed stations 28 and 30 respectively associated with the processing paths 20 and 22, as viewed in the predetermined direction of revolving motion U, there are provided respective outfeed or delivery stations 34 and 36 schematically indicated by respective arrows in FIGS. 1 and 2.

Figure 3:
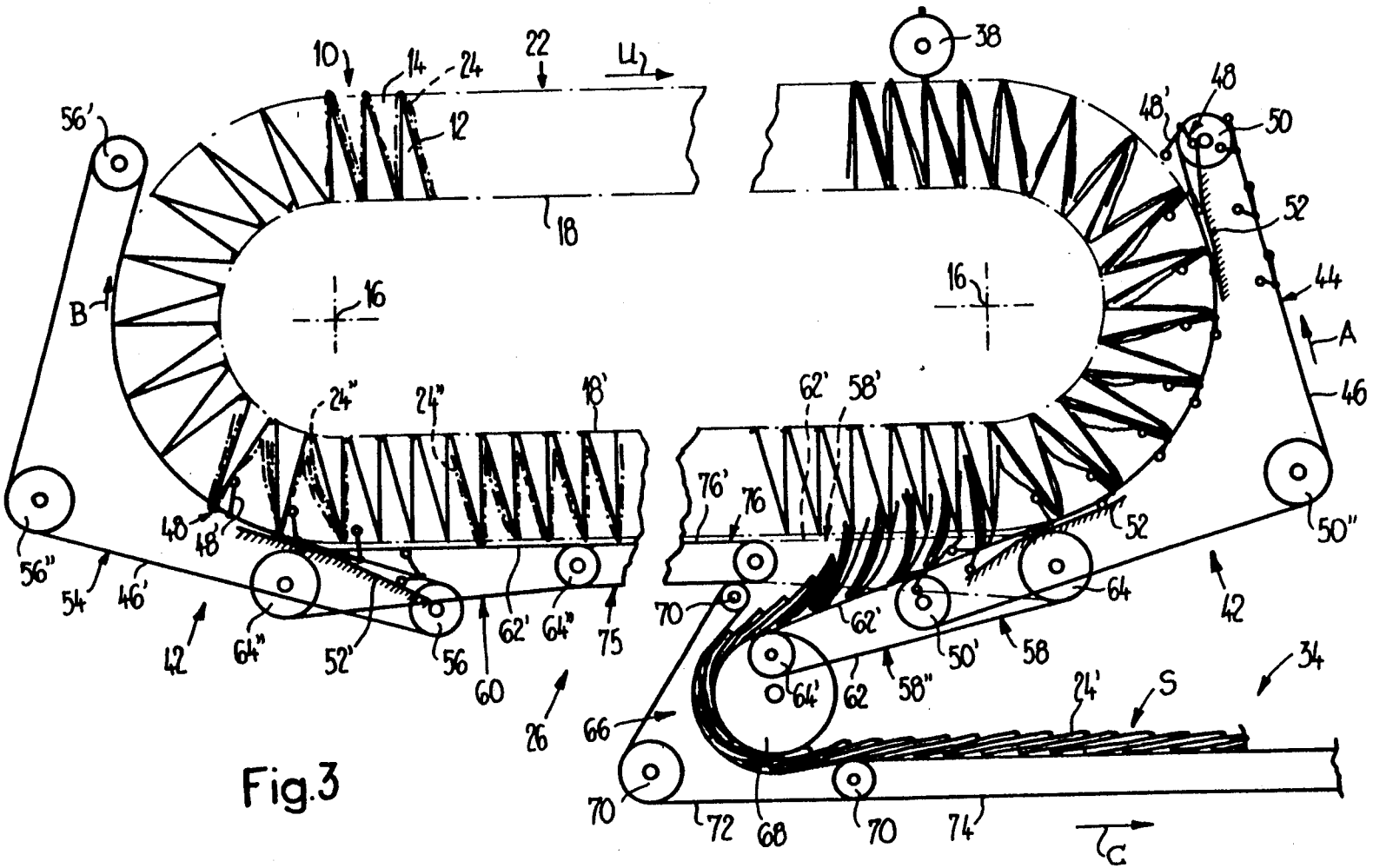
FIG. 3 is a schematic side view of the apparatus constructed according to the present invention.

The infeed devices 28' and 30' and the outfeed or delivery stations 34 and 36 provided with respective outfeed devices 74 depicted in FIG. 3 are generally known and have been disclosed in greater detail in the aforementioned European Patent Application No. 0,354,343 and its corresponding U.S. Pat. No. 5,094,348, the aforementioned European Patent Application No. 0,346,578 and its corresponding U.S. Pat. No. 5,104,108, the aforementioned German Published Patent Application No. 3,705,257 and the cognate U.S. Pat. No. 4,743,005, and the aforementioned European Patent Application No. 0,095,603 and the cognate U.S. Pat. No. 4,489,930. Reference may be readily made to these patents and the disclosures of which are incorporated herein by reference. It is for this reason that a more structural representation of the infeed devices 28' and 30' and of the outfeed stations 34 and 36 in the drawings and a detailed description thereof are thought unnecessary.

In the respective end regions of the two processing paths 20 and 22 there are provided respective engageable and disengageable stapling or stitching machines 38, whereby both machines 38 are in action during parallel operation of the two processing paths 20 and 22, as depicted in FIG. 1, while only the machine 38 associated to the second processing path 22 is activated when the two processing paths 20 and 22 are connected in series, as depicted in FIG. 2. It remains to be remarked that generally known opening devices 40 schematically indicated in FIGS. 1 and 2 are operatively associated with the infeed devices 28' and 30', respectively, in order to open folded printed products 24 to be deposited or positioned upon the saddle-shaped supports 12. Such opening devices 40 have been also illustrated and described in detail in the previously mentioned patents and published patent applications, to which reference may be readily had. In the case of disengaged or inoperative opening devices 40, the printed products 24 are inserted or stuffed into the pocket-like receiving sections 14, irrespective of whether the folded products 24 are retained by the grippers 32 in the region of their respective folds or in the region of their respective open lateral edges opposite the folds. However, when the folded printed products 24 are fixedly retained by respective grippers 32 in the region of their respective folds and the opening devices 40 are operative or again activated, then the folded printed products 24 are deposited in a straddling fashion or configuration upon the saddle-shaped supports 12, as depicted in FIGS. 1 and 2.

FIG. 3 illustrates the endless revolving conveying apparatus 10 in a schematic side view and likewise in a simplified representation. The saddle-shaped supports 12 revolvingly driven in the direction of revolving motion U are trained about the horizontal axes 16. Two successive supports 12 delimit therebetween in each case a related pocket-like receiving section 14. The infeed stations 28 and 30 have been omitted in FIG. 3 for purposes of clarity and simplification of the portrayal thereof. On the other hand, one stapling or stitching machine 38 has been schematically depicted in this Figure.

Figure 4:
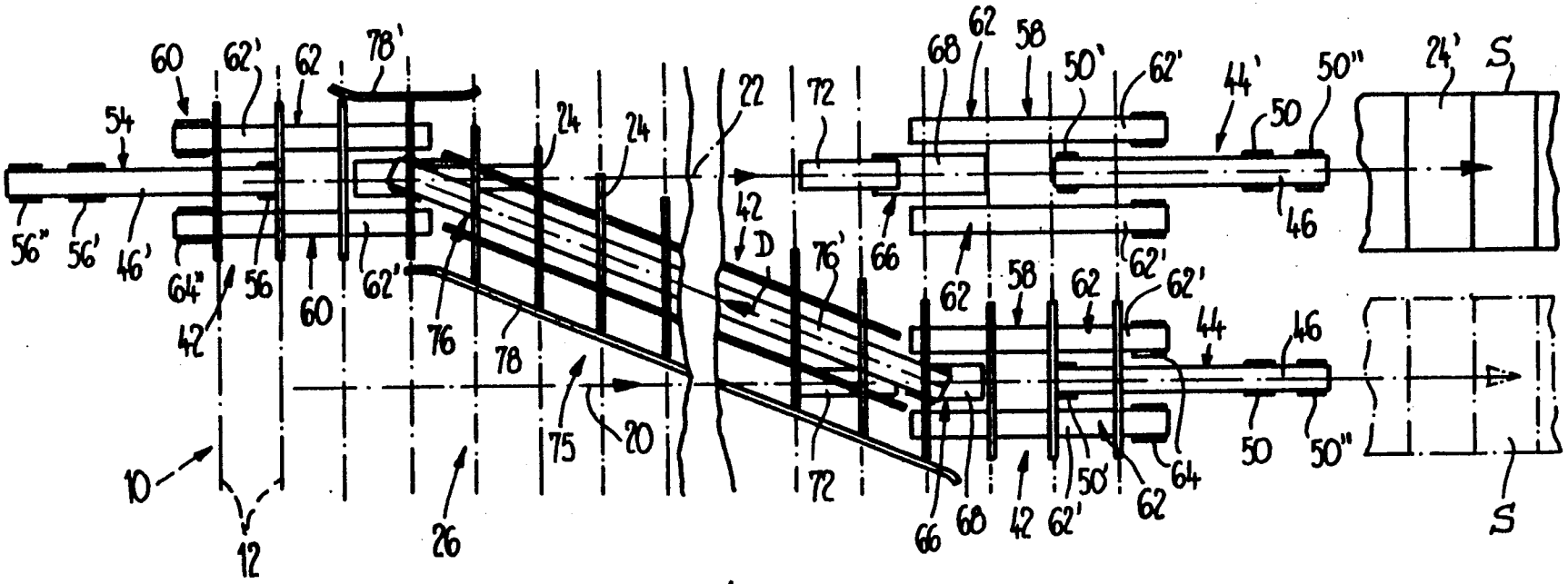
FIG. 4 schematically shows in a top plan view a part of the apparatus constructed according to the present invention, whereby a revolving conveying apparatus thereof is here supposed to be transparent and therefore indicated by dot-dash lines.

Retaining means 42 are provided in the regions of deflection or wrap about the two horizontal axes 16 as well as in the region or area of the lower run 18' of the conveying apparatus 10, as depicted in FIGS. 3 and 4, in order to prevent the folded printed products 24 from falling off the saddle-shaped supports 12 or, as the case may be, the printed products 24 from falling out of the pocket-like receiving sections 14. In the region of deflection about the horizontal axis 16 located at the end or end portion of the conveying apparatus 10, retaining devices 44 and 44' are respectively arranged downstream of the processing paths 20 and 22, as viewed in the predetermined direction of revolving motion U. FIGS. 3 and 4 respectively depict in a side view only the retaining device 44 of the first processing path 20 and in a top plan view both retaining devices 44 and 44' of the two processing paths 20 and 22, respectively. These retaining devices 44 and 44' comprise respective endless traction or driving elements 46 revolvingly driven in a direction which has been generally indicated by the arrow A. At these traction elements 46 there are provided holding elements 48 which are pivotably mounted and tandemly arranged. The distance or spacing between successive holding elements 48 corresponds approximately with the essentially uniform spacing between the free ends or end portions of successive saddle-shaped supports 12 in the region of deflection or wrap about the horizontal axis 16 located at the end of the conveying apparatus 10. The endless traction elements 46, for instance in the form of chains or belts, are trained around respective rolls or rollers 50, 50' and 50'' and slidingly mounted in not particularly illustrated but conventional guides or guideways located in the region facing the conveying apparatus 10 between the two rolls or rollers 50 and 50'. In this region facing the conveying apparatus 10 and located between the rolls 50 and 50', there are provided respective control cams 52 which pivot the holding elements 48 of the traction elements 46 such that in each case a holding finger 48' of the related holding element 48 moves into and engages the respective pocket-like receiving section 14, in order to prevent the folded printed product or products 24 deposited upon the respective saddle-shaped support 12 from opening or, as the case may be, to prevent the printed product or products 24 inserted into the related pocket-like receiving section 14 from falling out.

In the region of deflection or wrap about the horizontal axis 16 located at the start of the endless revolving conveying apparatus 10 there is provided a further retaining device 54 arranged upstream of the second processing path 22 as viewed in the direction of revolving motion U, this retaining device 54 being constructed in the same manner as the retaining devices 44 and 44'. An endless traction or driving element 46' is guided around respective rolls or rollers 56, 56' and 56'' and revolvingly driven in a direction which has been generally indicated by the arrow B. At this traction element 46' there are provided holding elements conveniently likewise designated by reference numeral 48 and pivotably arranged in tandem relationship. These holding elements 48 are pivotable in the retaining-active region or area located between the two rolls or rollers 56 and 56' order to move into and engage respective pocket-like receiving sections 14 by means of respective holding fingers 48' of the related holding elements 48. In this retaining-active region or area facing the conveying apparatus 10 and located between the rolls 56 and 56', the endless traction element 46' is guided in a suitable but not particularly illustrated guide or guideway. Furthermore, in this retaining-active region or area there is arranged a control cam 52' for the purpose of appropriately pivoting the holding elements 48.

As viewed in the predetermined direction of revolving motion U, two belt conveyors 58 are respectively arranged downstream of the two retaining devices 44 and 44', and a further belt conveyor 60 is arranged upstream of the retaining device 54. Each of the three belt conveyors 58 and 60 comprises two endless belts or bands 62 which extend substantially parallel to each other and are arranged in a laterally spaced relationship to one another. As will be recognized from the illustration of FIG. 4, the traction or driving elements 46 of the retaining devices 44 and 44' respectively extend to a certain degree between the two endless belts or bands 62 of the belt conveyor 58 associated with the first processing path 20 and between the two endless belts or bands 62 of the belt conveyor 58 associated with the second processing path 22, and the traction or driving element 46' of the further retaining device 54 extends to a certain degree between the two endless belts or bands 62 of the belt conveyor 60.

The two endless belts or bands 62 of the belt conveyor 58 associated with the first processing path 20 are guided around deflection rolls 64 and 64', whereby this belt conveyor 58 is reciprocatingly pivotable in rocker-like manner about the rotational axis of the first deflection roll 64, as viewed in the direction of revolving motion U, between a retaining position 58' indicated in dot-dash lines and an outfeed position 58" depicted in full lines in FIG. 3. When the pivotable belt conveyor 58 associated with the first processing path 20 assumes the retaining position 58', the upper runs 62' of the endless belts or bands 62, these upper runs 62' facing the conveying apparatus 10, extend in parallel and neighboring relationship to the free ends or end portions of the saddle-shaped supports 12, in order to prevent the folded printed products 24 deposited on the supports 12 and the printed products 24 inserted into the receiving sections 14 from falling down. This is the case when the two processing paths 20 and 22 are connected to operate in series.

The belt conveyor 58 associated to the second processing path 22 is structured in the same manner as the other belt conveyor 58 associated to the first processing path 20, except that the belt conveyor 58 operatively associated with the second processing path 22 is not pivotable and thus always assumes a position corresponding to the outfeed position 58".

During parallel operation of the two processing paths 20 and 22, the processed printed products 24, i.e. the end products conveniently designated by reference numeral 24', are transported away side-by-side and in parallel. For this purpose, the belt conveyor 58 operatively associated with the retaining device 44 of the first processing path 20 is pivoted into the outfeed position 58" (cf. FIG. 3). During such pivoting travel the upper runs 62' of the endless belts or bands 62 withdraw downwardly from the lower run 18' of the conveying apparatus 10, as viewed in the direction of revolving motion U. As a result, the printed products 24 deposited upon the supports 12 or stuffed into the receiving sections 14 in the region of the linear processing paths 20 and 22 come to rest as end products 24' in an imbricated formation or array S upon the respective upper runs 62' of the two belt conveyors 58. In this imbricated formation S an end product 24' is partially covered in each case by the next leading or downstream end product 24'.

The belt conveyors 58 convey the end products 24' to respective deflection devices 66 of the two outfeed or delivery stations 34 and 36 (cf. FIGS. 1, 3 and 4), at which the end products 24' are deflected or trained around respective rollers 68 such that in the imbricated formation S of end products 24' transported away, as viewed in the outfeed direction indicated by arrow C, an end product 24' bears in each case upon the next leading or downstream end product 24'. Endless belts or bands 72 appropriately guided around respective rolls or rollers 70 train or partially wrap around respective rollers 68 and, together with the latter, delimit respective conveying gaps, in order to retain during deflection the end products 24' at the rollers 68. The end products 24' coming from the deflection devices 66 in imbricated formations S are transported away by means of the outfeed devices or outfeeders 74.

The endless belts or bands 62 of the belt conveyor 60 are guided around respective stationarily arranged deflection rolls 64" (FIG. 3) in such a manner that the respective upper runs 62', which face the conveying apparatus 10, extend in neighboring relationship to the free ends or end portions of the saddle-shaped supports 12, in order to prevent the printed products 24 from falling off the supports 12 or from falling out of the receiving sections 14.

A transport or transfer device 75 is provided between the belt conveyor 58 arranged downstream of the first processing path 20 and the belt conveyor 60 arranged upstream of the second processing path 22, as viewed in the direction of revolving motion U. This transport or transfer device 75 comprises a stationarily arranged belt conveyor 76 extending transversely relative to the direction of revolving motion U. The upper conveying-active and carrying-active run 76' of the belt conveyor 76 extends in neighboring relationship to and at a short spacing from the free ends or end portions of the saddle-shaped supports 12. As viewed in the conveying direction D of the belt conveyor 76, a guide member 78 extends on the left-hand side of and substantially parallel to the upper run 76', this guide member 78 laterally acting upon the printed products 24 which come to bear upon the belt conveyor 76, in order to ensure the displacement of the printed products 24 in a direction extending transversely to the predetermined direction of revolving motion U and in the conveying direction D of the belt conveyor 76. In the end region of the belt conveyor 76 and in the starting area of the belt conveyor 60 there is provided a further guide member 78' which, as viewed in the conveying direction D, is located on the right-hand side of the belt conveyor 76. This further guide member 78' extends substantially parallel to the direction of revolving motion U and aligns the printed products 24 transferred from the belt conveyor 76 to the belt conveyor 60.

Figure 5:
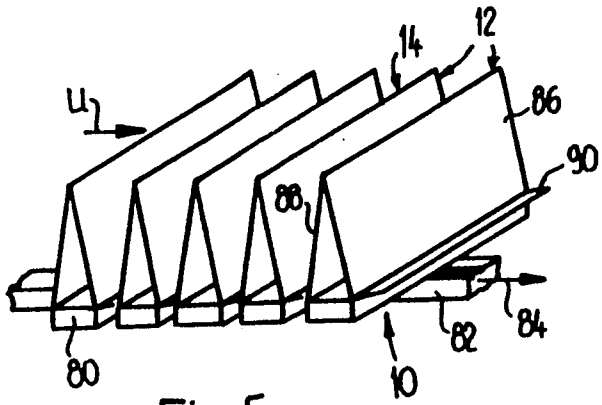
FIG. 5 is a schematic perspective view of a part or portion of the conveying apparatus.

Each of the saddle-shaped supports 12 common to both processing paths 20 and 22 comprises a profile-like supporting body 80 which is displaceably guided in an independently closed guide track 82 having a substantially C-shaped cross-section, as schematically indicated in a part or portion of the endless revolving conveying apparatus 10 depicted in FIG. 5. Within this guide track 82 there extends a traction or driving element generally indicated by the arrow 84 and which is driven in the predetermined direction of revolving motion U and connected with the profile-like supporting bodies 80 of the saddle-shaped supports 12. The cross-section of the supports 12 is similar to an acute triangle, the base of which is formed by the related profile-like supporting body 80. The lateral sides of the acute triangle are formed by a front wall or panel 86 and a rear wall or panel 88. A floor or tray element 90 juts out from each supporting body 80, such floor or tray element 90 overlapping in each case the supporting body 80 of the next leading or downstream saddle-shaped support 12, as viewed in the predetermined direction of revolving motion U (cf. FIGS. 6 and 7). The front wall or panel 86 and the floor or tray element 90 of a support 12, and the rear wall or panel 88 of the next leading or downstream support 12 thus bound or delimit in each case a pocket-like receiving section 14.

Figure 6:
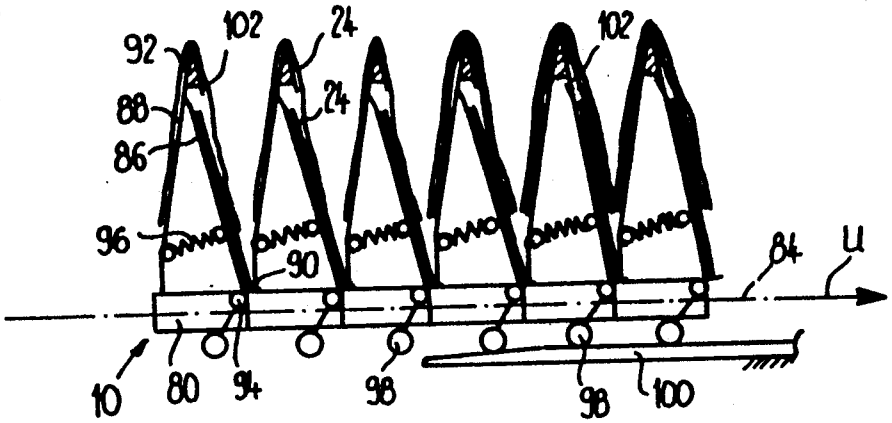
FIG. 6 schematically shows in a side view, partially in section, a part or portion of the conveying apparatus in the region of the upper run thereof.
Figure 7:
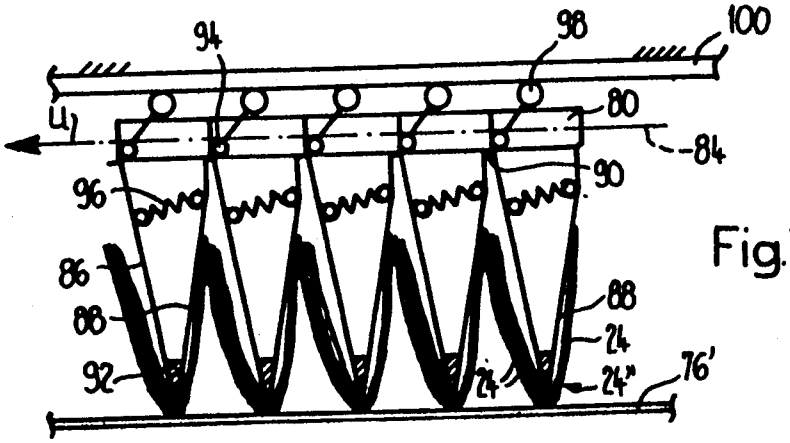
FIG. 7 schematically shows in a side view, partially in section, a part or portion of the conveying apparatus in the region of the lower run thereof.
Figure 8:
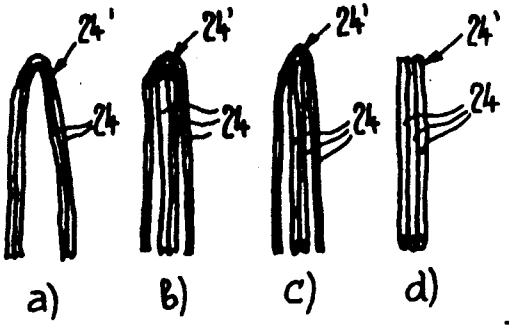
FIG. 8*a* schematically shows a first end product of printed products collected by means of the apparatus constructed according to the present invention and depicted in FIGS. 1 through 7.
FIG. 8*b* schematically shows a second end product of printed products assembled and collected by means of the apparatus constructed according to the present invention and depicted in FIGS. 1 through 7.
FIG. 8*c* schematically shows a third end product of printed products assembled and collected by means of the apparatus constructed according to the present invention and depicted in FIGS. 1 through 7.
FIG. 8*d* schematically shows a fourth end product of printed products assembled by means of the apparatus constructed according to the present invention and depicted in FIGS. 1 through 7.

The plate-like rear wall or panel 88 is in each case fixedly arranged at the profile-like supporting body 80 and carries at its free end-region a support form or profile 92 having an approximately triangular cross-section, as shown in FIGS. 6 and 7. The likewise plate-like structured front wall or panel 86 is in each case pivotably mounted at the related profile-like supporting body 80 for pivoting motion about an axis 94, whereby the free end of the front wall or panel 86 is in each case appropriately covered by the related support form or profile 92. A tension spring 96 acting between the front wall 86 and the rear wall 88 retains the aforesaid free end of the front wall or panel 86 in a rest or normal position, the free end butting against the related rear wall or panel 88 (FIG. 6). A pivoting-active cam 100 extends from the end region of the processing paths 20 and 22 through the region of deflection about the horizontal axis 16 depicted at the right-hand side of FIGS. 1, 2 and 3, and through the starting region of the lower run 18' of the conveying apparatus 10, this pivoting-active cam 100 co-acting with sliding or guide shoes 98 connected with respective front walls or panels 86, in order to pivot in these regions the front walls or panels 86 against the force of the tension springs 96 into a position, in which the free ends of respective front walls or panels 86 bear against stopping tongues or blades 102 jutting out from respective support forms or profiles 92, so that the front walls or panels 86 are substantially in alignment with the surface of the support forms or profiles 92. When the front walls or panels 86 are in their rest or normal position, the printed products 24 inserted into the receiving sections 14 and leaning or bearing at the front walls 86 are conveniently covered by the respective support forms or profiles 92, as depicted in FIG. 6, so that if need be, further folded printed products 24 can be readily deposited in a straddling fashion upon the saddle-shaped supports 12 and over the printed products 24 previously inserted into the pocket-like receiving sections 14.

In order to ensure that in the region of the upper run 18 the printed products 24 inserted or dropped into the pocket-like receiving sections 14 bear in each case against the front wall or panel 86 of the next trailing or upstream saddle-shaped support 12 forming the rear pocket wall of the related receiving section 14, the rear walls 88 of the supports 12 forming the front pocket walls of the receiving sections 14 are steeper than the front walls 86 with respect to the level or horizontal plane, whereby if need be the rear walls 88 can be curved as illustrated in FIGS. 6 and 7.

Before in each case a saddle-shaped support 12 is deflected or trained into the region of the lower run 18' of the endless revolving conveying apparatus 10, pivoting of the related front wall 86 is required, in order to ensure that the printed products 24 inserted or dropped into the respective receiving stations 14 can slide in the direction towards the free ends of the respective supports 12 for the purpose of being transported away or, as the case may be, displaced transversely with respect to the direction of revolving motion U by means of the transport or transfer device 75. It is to be remarked that at the supports 12 or in the receiving sections 14 there are neither holding means to keep the printed products 24 in the region of the lower run 18', nor shifting means to displace the printed products 24 in the lengthwise direction of the supports 12 or, as the case may be, in the lengthwise direction of the receiving sections 14. The transport or transfer device 75 as well as the retaining means 42 extend externally of the endless revolving conveying apparatus 10, thus rendering possible a particularly simple construction of the conveying apparatus 10.

FIGS. 8*a* through 8*d* illustrate different end products 24' collected and/or assembled from individual printed products 24 by means of the aforedescribed apparatus for processing printed products and constructed according to the present invention.

FIG. 8*a* shows an end product 24' achieved by collecting folded printed products 24, whereby the individual folded printed products 24 were deposited in each case in a straddling fashion upon the saddle-shaped supports 12 or, as the case may be, upon the printed product or products 24 previously positioned on the respective saddle-shaped supports 12. In order to form the end products 24' depicted in FIGS. 8*b* and 8*c*, first of all two folded printed products 24 are successively inserted with the open lateral edge located opposite the product fold leading (cf. FIG. 8*b*) or with the product fold leading (cf. FIG. 8*c*) into a pocket-like receiving section 14, and thereafter at least one further folded printed product 24 is deposited in a straddling fashion upon the related trailing or upstream support 12 of the receiving section 14 and over the aforesaid two folded printed products 24 previously inserted one after another into the receiving section 14. FIG. 8*d* shows an end product 24' achieved solely by assembling or bringing together several individual printed products 24, each of which is inserted into the pocket-like receiving section 14 and placed alongside the front wall or panel 86, i.e. the rear pocket wall, of the related upstream saddle-shaped support 12 or, as the case may be, beside the printed product or products 24 previously inserted or stuffed into the receiving section 14.

Having now had the benefit of the foregoing description of the exemplary embodiments of the apparatus as considered with respect to FIGS. 1 through 8, the mode of operation of the apparatus for processing printed products and constructed according to the present invention is hereinafter described and is as follows:

FIG. 1 illustrates the heretofore described apparatus in the course of collecting printed products 24 during parallel operation thereof. The transport or transfer device 75 is disengaged or can be switched off and the belt conveyor 58 located downstream of the first processing path 20 is pivoted into the outfeed position 58" thereof (cf. FIG. 3), in order to feed or deliver the printed products 24 collected along the first processing path 20 to the outfeed or delivery station 34. During the collecting process the first infeed stations 28 and 30, as viewed in the direction of revolving motion U, simultaneously open in each case respective folded printed products 24 and deposit the latter in a straddling fashion upon a common saddle-shaped support 12. These printed products 24 positioned on the common support 12 are conveyed further by the endless revolving conveying apparatus 10, and at the infeed stations 28 and 30 arranged after or downstream of the aforesaid first infeed stations 28 and 30 a further folded printed product 24 is in each case simultaneously opened and deposited in a straddling fashion upon each of the previously positioned printed products 24. In the end region of the processing paths 20 and 22, the collected printed products 24 are respectively stapled or stitched by means of the stapling or stitching machines 38. As will be evident from FIG. 3, the end products 24' come to rest in an imbricated or shingled formation upon the respective belt conveyors 58, are then deflected and trained around respective rollers 68 in the deflection devices 66 and delivered to the respective outfeed devices or outfeeders 74 of the outfeed or delivery stations 34 and 36. The maximum number of superposedly positionable folded printed products 24 is given, on the one hand, by the number of infeed stations 28 provided along the first processing path 20 and, on the other hand, by the number of infeed stations 30 provided along the second processing path 22.

When the apparatus is set to operate in series, as will be recognized from the illustration of FIG. 2, the maximum number of superposedly positionable folded printed products 24 is given or determined by the sum or total of the infeed stations 28 in the first processing path 20 and the infeed stations 30 in the second processing path 22. For series operation the belt conveyor 58 arranged downstream of the first processing path 20 is pivoted into the retaining position 58'. While the related deflection device 66 and the respective outfeed device or outfeeder 74 are put out of operation, the transport or transfer device 75 is activated. The printed products 24 collected in the first processing path 20 and forming in each case an intermediate product 24" arrive in the region of the lower run 18' by deflection or wraparound of the saddle-shaped supports 12 about the horizontal axis 16 depicted at the right-hand side in FIG. 2, whereby in the region of deflection the corresponding folded printed products 24 deposited on the saddle-shaped supports 12 are prevented by the associated retaining device 44 from opening or falling down. The collected printed products 24 are delivered to the transport or transfer device 75 by the belt conveyor 58 located in its retaining position 58', whereby the collected products 24 are delivered with the product folds thereof bearing upon the upper runs 62' of the belt conveyor 58. At the transport or transfer device 75, the intermediate products 24" further conveyed by the endless revolving conveying apparatus 10 in the direction of revolving motion U are delivered in the conveying direction D to the belt conveyor 60 disposed upstream of the second processing path 22, this belt conveyor 60 together with the downstream arranged retaining device 54 further ensuring that the intermediate products 24" cannot fall down or loop out of the pocket-like receiving sections 14 and thereby possibly incur damage. In the region of the second processing path 22, further folded printed products 24 are then deposited at the respective infeed stations 30 in a straddling manner upon the printed products 24 collected along the first processing path 20 to form intermediate products 24". At the end or end region of the second processing path 22 the collected end products 24' are stapled or stitched by means of the stapling or stitching machine 38 and delivered to the outfeed device or outfeeder 74 of the outfeed or delivery station 36 in the same way as in the case of parallel operation or processing.

The two processing paths 20 and 22 can be connected in parallel or in series likewise for assembling or bringing together printed products 24. In such case, a printed product 24 is inserted each time into each receiving section 14 at the infeed stations 28 and 30, whereby these printed products 24 need not be folded. The printed products 24 inserted into the receiving sections 14, i.e. between the supports 12, by the infeed devices 28' and 30' associated with the processing paths 20 and 22, respectively, come to bear in each case side by side against one another, as depicted in FIG. 8*d*.

For the purpose of producing end products 24' according to FIG. 8*b* and FIG. 8*c*, the two processing paths 20 and 22 can be also selectively or alternatively run in parallel or in series, according to the number of individual printed products 24 which have to be assembled to produce an end product 24'. The production of such end products 24' according to FIGS. 8*b* and 8*c* is indicated in FIGS. 3, 6 and 7. In the course of the first processing path 20, printed products 24 are inserted into receiving sections 14 at the first two infeed stations 28, as viewed in the direction of revolving motion U, so that after moving past the second infeed station 28 there are two printed products 24 resting side by side in each receiving section 14. Then at the third infeed station 28 of the first processing path 20, a folded printed product 24 is deposited in a straddling fashion upon the saddle-shaped support 12 and over the previously assembled printed products 24. During deflection or wraparound travel of the supports 12 and the receiving sections 14 about the horizontal axis 16 depicted at the right-hand side in FIG. 3, the folded printed product 24 last deposited in a straddling fashion is prevented from opening and the assembled printed products 24 are prevented from falling down by means of the respective holding or retaining elements 48 of the retaining device 44. In the region of the lower run 18' of the conveying apparatus 10, the assembled printed products 24 then slide downwardly, as depicted in FIG. 7, so that these assembled printed products 24 together with the folded printed product 24 positioned in a straddling configuration, thereby forming an intermediate product 24", can be transversely displaced or shifted by means of the transport or transfer device 75 and delivered thereafter to the second processing path 22. Upon arriving at the upper run 18, the assembled printed products 24 fall under the action of their own weight and again bear at the respective floor or tray elements 90 and, at the infeed stations 30, further folded printed products 24 are deposited in a straddling fashion upon the folded printed product or products 24 which has or have been previously positioned upon the corresponding saddle-shaped supports 12 (FIG. 6). If need be, the in collecting manner superposedly deposited printed products 24 can then be stapled or stitched together by means of the stapling or stitching machine 38 provided at the end or end portion of the second processing path 22. Subsequent to deflection about the horizontal axis 16 depicted at the right-hand side in FIG. 3, the assembled printed products 24 then again fall in each case into the respective collected folded printed products 24, so that the finalized or completed end products 24' are delivered to the outfeeder 74 while forming an imbricated formation or array S.

When the infeed stations 28 and 30 are structured as infeed devices 28' and 30', the change-over or adaptation from collecting to assembling or, as the case may be, to a combination of assembling and collecting is accomplished in an extremely simple manner in that only the respective opening devices 40 have to be switched on or off and the printed products 24 have to be correctly and appropriately delivered, i.e. with the product fold leading or, as the case may be, with the open lateral edge leading, the latter being located opposite the product fold. The reversal or change-over from parallel operation to series operation and vice versa is also an extremely simple process.

Of course, it is possible to provide supports 12 with respective front walls or panels 86 that are fixedly mounted and not pivotable about respective axes 94. This is particularly conceivable when by means of this apparatus printed products 24 are exclusively collected or exclusively assembled. For the displacement or conveyance of printed products 24 in the lengthwise direction of the supports 12 or of the receiving stations 14, i.e. in the direction transverse to the direction of revolving motion U, there can be also provided a transport device which, if necessary, extends externally of the conveying apparatus 10 and comprises individually controllable grippers, whereby for series operation each gripper grasps the corresponding printed product 24 and conveys the latter into the region located below the second processing path 22. Naturally, this transport device would be inactive when the processing paths 20 and 22 are connected to operate in parallel. It is also readily conceivable to provide a selectively controllable transport means in each pocket-like receiving section 14, in order to convey during series operation the printed products 24 from the first processing path 20 to the second processing path 22 and, if necessary, to simultaneously prevent the printed products 24 from falling down.

The number of infeed stations 28 and 30 along each of the processing paths 20 and 22, respectively, can be larger or smaller according to the size of the inventive apparatus for processing printed products.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of processing printed products, such as newspapers, magazines and the like, comprising the steps of:

providing a first processing path;

driving a plurality of printed product receiving supports along said first processing path;

arranging a first infeed supply along said first processing path;

depositing printed products upon said printed product receiving supports with said first infeed supply;

selectively collecting or assembling printed products along the first processing path and respectively producing an end product or an intermediate product;

subsequently transporting away the printed products;

providing a second processing path;

driving a plurality of printed product receiving supports along said second processing path;

arranging a second infeed supply along said second processing path;

depositing printed products upon said printed product receiving supports with said second infeed supply;

selectively connecting in parallel or in series the second processing path to the first processing path;

simultaneously selectively collecting or assembling further printed products along the second processing path; and subsequently transporting away the further printed products.

2. The method as defined in claim 1, further including the steps of:

providing an endless revolving conveying apparatus passing through both processing paths, said endless revolving conveying apparatus comprising said printed product receiving supports;

the first processing path and the second processing path being substantially linear at least by sectors;

arranging a plurality of infeed stations successively along the substantially linear processing paths to define said infeed supplies; and transferring the printed products at the infeed stations to the endless revolving conveying apparatus.

3. The method of claim 1 further comprising the steps of:

providing a first outfeed station arranged downstream of said first infeed supply for transporting away said printed products;

providing a second outfeed station arranged downstream of said second infeed supply for transporting away said further printed products; and disengaging said first outfeed supply when said processing paths are connected in series.

4. An apparatus for processing printed products, such as newspapers, magazines and the like, comprising:

a first processing path;

said first processing path being substantially linear at least by sectors;

an endless revolving conveying apparatus passing through said first processing path and defining a predetermined direction of revolving motion;

said endless revolving conveying apparatus comprising saddle-shaped supports extending transversely with respect to said predetermined direction of revolving motion:

the printed products also including folded printed products;

said saddle-shaped supports serving to take up the folded printed products in a straddling configuration;

several infeed stations successively arranged along said first processing path for depositing in a straddling fashion said folded printed products upon said saddle-shaped supports or, as the case may be, upon previously deposited folded printed products;

an outfeed station arranged downstream of said infeed stations as viewed in said predetermined direction of revolving motion;

said outfeed station serving to transport away the folded printed products deposited one on top of the other;

a second processing path;

further infeed stations successively arranged along said second processing path;

a further outfeed station arranged downstream of said further infeed stations as viewed in said predetermined direction of revolving motion;

said endless revolving conveying apparatus passing through said second processing path;

means for selectively connecting said first processing path and said second processing path in parallel or in series; and said outfeed station associated with said first processing path being disengageable when said processing paths are connected in series.

5. The apparatus as defined in claim 4, wherein:

said first processing path contains an end portion as viewed in said predetermined direction of revolving motion;

said second processing path contains a start portion as viewed in said predetermined direction of revolving motion;

said selectively connecting means constitute transport means provided between said end portion of said first processing path and said start portion of said second processing path; and said transport means being conveying-active when said processing paths are connected in series.

6. The apparatus as defined in claim 4, further including:

pocket-like receiving sections respectively provided between said saddle-shaped supports; and said infeed stations successively arranged along said first processing path and said further infeed stations successively arranged along said second processing path being structured to selectively deposit folded printed products upon said saddle-shaped supports or insert printed products into said pocket-like receiving sections.

7. The apparatus as defined in claim 6, wherein:

said infeed stations successively arranged along said processing paths comprise respective infeed devices;

each said infeed device comprising revolvingly driven and successively arranged grippers having a predetermined conveying direction;

each said infeed device containing a delivery region for printed-product transfer to said endless revolving conveying apparatus;

said predetermined conveying direction extending at said delivery region approximately in the same direction with respect to said predetermined direction of revolving motion; and opening devices are provided in order to open the folded printed products to be deposited upon said saddle-shaped supports.

8. The apparatus as defined in claim 6, wherein:

said first processing path and said second processing path extend side by side and substantially parallel to each other; and said saddle-shaped supports and said pocket-like receiving sections of said endless revolving conveying apparatus being commonly associated with said mutually parallel processing paths.

9. The apparatus as defined in claim 8, wherein:

said endless revolving conveying apparatus comprises an upper run extending along said mutually parallel processing paths and a lower run;

retaining means are provided in the region of said lower run in order to prevent the printed products from falling down; and said selectively connecting means constitute a transport device serving to convey the printed products in a direction extending transversely with respect to said predetermined direction of revolving motion when said first processing path and said second processing path are connected to operate in series.

10. The apparatus as defined in claim 9, wherein:

said transport device is located in the region of said lower run of said endless revolving conveying apparatus.

11. The apparatus as defined in claim 9, wherein:

said retaining means comprise endless retaining belts revolving externally of said endless revolving conveying apparatus;

each said endless retaining belt possessing a retaining-active run; and said endless retaining belts revolving with said retaining-active runs thereof at a slight spacing from said saddle-shaped supports.

12. The apparatus as defined in claim 9, wherein:

said retaining means comprise endless retaining belts revolving externally of said endless revolving conveying apparatus;

each said endless retaining belt possessing a retaining-active run; and said endless retaining belts bearing with their retaining-active runs at said saddle-shaped supports or, as the case may be, at the printed products deposited thereat.

13. The apparatus as defined in claim 9, wherein:

said retaining means comprise endless retaining chains revolving externally of said endless revolving conveying apparatus;

each said endless retaining chain possessing a retaining-active run; and said endless retaining chains being arranged with said retaining-active runs thereof at a slight distance from said saddle-shaped supports.

14. The apparatus as defined in claim 9, wherein:

said retaining means comprise endless retaining chains revolving externally of said endless revolving conveying apparatus;

each said endless retaining chain possessing a retaining-active run; and said endless retaining chains bearing with their retaining-active runs at said saddle-shaped supports or, as the case may be, at the printed products deposited thereat.

15. The apparatus as defined in claim 10, wherein:

said transport device comprises an endless belt conveyor revolvingly driven in a direction extending transversely to said predetermined direction of revolving motion;

said endless belt conveyor having a conveying-active run facing said endless revolving conveying apparatus; and the printed products coming to bear upon said conveying-active run of said endless belt conveyor and being at the same time prevented from falling off said saddle-shaped supports or, as the case may be, falling out of said pocketlike receiving sections.

16. The apparatus as defined in claim 10, wherein:

said transport device comprises an endless chain conveyor revolvingly driven in a direction extending transversely with respect to said predetermined direction of revolving motion;

said endless chain conveyor possessing a conveying-active run facing said endless revolving conveying apparatus; and the printed products coming to bear upon said conveying-active run of said endless chain conveyor and being at the same time prevented from falling off said saddle-shaped supports or, as the case may be, falling out of said pocketlike receiving sections.

17. The apparatus as defined in claim 10, wherein:

said outfeed station associated with said first processing path is located in the region of said lower run of said endless revolving conveying apparatus;

said retaining means comprise a belt conveyor included in said selectively connecting means;

said belt conveyor being pivotable in switch-like manner between a retaining position and an outfeed position;

said belt conveyor in said retaining position serving to prevent the printed products from falling off said saddle-shaped supports or, as the case may be, from falling out of said pocket-like receiving sections; and said belt conveyor in said outfeed position serving to deliver the corresponding printed products to said outfeed station associated with said first processing path.

18. The apparatus as defined in claim 6, wherein:

said saddle-shaped supports comprise respective wall elements;

each of said pocket-like receiving sections being bounded by said wall elements associated with the saddle-shaped supports adjacent thereto;

one of said wall elements of each saddle-shaped support being pivotably mounted and having a free end;

each saddle-shaped support possessing a receiving end constituting a supporting element; and a control device is provided for pivoting in each case said one pivotably mounted wall element such that said free end thereof comes to rest substantially beneath the related supporting element and that the printed products inserted into said pocket-like receiving sections and bearing at respective pivotably mounted wall elements are also brought to reside beneath respective supporting elements.

19. An apparatus for processing printed products, such as newspapers, magazines and the like, comprising:

a first processing path;

said first processing path being substantially linear at least by sectors;

an endless revolving conveying apparatus passing through said first processing path and defining a predetermined direction of revolving motion;

said endless revolving conveying apparatus comprising pocket-like receiving sections extending transversely with respect to said predetermined direction of revolving motion;

said pocket-like receiving sections serving to receive printed products;

several infeed stations successively arranged along said first processing path for inserting the printed products into said pocket-like receiving sections;

an outfeed station arranged downstream of said infeed stations as viewed in said predetermined direction of revolving motion;

said outfeed station serving to transport away the printed products inserted into said pocket-like receiving sections;

a second processing path;

further infeed stations successively arranged along said second processing path;

a further outfeed station arranged downstream of said further infeed stations as viewed in said predetermined direction of revolving motion;

said endless revolving conveying apparatus passing through said second processing path provided with said further infeed stations and said further outfeed station;

means for selectively connecting said first processing path and said second processing path in parallel or in series; and said outfeed station associated with said first processing path being disengageable when said processing paths are connected in series.

20. The apparatus as defined in claim 19, wherein:

said first processing path contains an end portion as viewed in said predetermined direction of revolving motion;

said second processing path contains a start portion as viewed in said predetermined direction of revolving motion;

said selectively connecting means constitute transport means provided between said end portion of said first processing path and said start portion of said second processing path; and said transport means being conveying-active when said processing paths are connected in series.

21. The apparatus as defined in claim 20, wherein:

said infeed stations successively arranged along said first processing path and said further infeed stations successively arranged along said second processing path comprise respective infeed devices;

each said infeed device comprising revolvingly driven and successively arranged grippers having a predetermined conveying direction;

each said infeed device containing a delivery region for printed-product transfer to said endless revolving conveying apparatus; and said predetermined conveying direction extending at said delivery region approximately in the same direction as said predetermined direction of revolving motion.

22. The apparatus as defined in claim 21, wherein:

said first processing path and said second processing path extend side by side and substantially parallel to each other; and said pocket-like receiving sections of said endless revolving conveying apparatus being commonly associated with said mutually parallel processing paths.

23. The apparatus as defined in claim 22, wherein:

said endless revolving conveying apparatus comprises an upper run extending along said processing paths and a lower run;

retaining means are provided in the region of said lower run in order to prevent the printed products from falling down; and said transport means constitute a transport device likewise provided in the region of said lower run for the purpose of conveying the printed products in a direction substantially transverse with respect to said predetermined direction of revolving motion when said processing paths are connected in series.

24. The apparatus as defined in claim 23, wherein:

said retaining means located in the region of said lower run comprise endless retaining belts revolving externally of said endless revolving conveying apparatus;

each said endless retaining belt possessing a retaining-active run; and said endless retaining belts revolving with said retaining-active runs thereof at a slight spacing from said pocket-like receiving sections.

25. The apparatus as defined in claim 23, wherein:

said retaining means located in the region of said lower run comprise endless retaining belts revolving externally of said endless revolving conveying apparatus;

each said endless retaining belt possessing a retaining-active run; and said endless retaining belts bearing with their retaining-active runs at said pocket-like receiving sections.

26. The apparatus as defined in claim 23, wherein:

said transport device located in the region of said lower run comprises an endless belt conveyor revolvingly driven in a direction extending transversely with respect to said predetermined direction of revolving motion;

said endless belt conveyor having a conveying-active run facing said endless revolving conveying apparatus; and the printed products coming to bear upon said conveying-active run of said endless belt conveyor and being at the same time prevented from falling out of said pocketlike receiving sections.

27. The apparatus as defined in claim 26, wherein:

said outfeed station associated with said first processing path is located in the region of said lower run of said conveying apparatus;

said selectively connecting means constitute further retaining means located in the region of said lower run;

said further retaining means comprise a belt conveyor pivotable in switch-like manner between a retaining position and an outfeed position;

said pivotable belt conveyor in said retaining position serving to prevent the printed products from falling out of said pocket-like receiving sections; and said pivotable belt conveyor in said outfeed position serving to deliver the corresponding printed products to said outfeed station associated with said first processing path.

* * * * *